US012790832B2

(12) United States Patent
Boucké

(10) Patent No.: US 12,790,832 B2
(45) Date of Patent: Nov. 10, 2026

(54) PANEL, IN PARTICULAR A FLOOR OR WALL PANEL

(71) Applicant: I4F Licensing NV, Turnhout (BE)

(72) Inventor: Eddy Alberic Boucké, Turnhout (BE)

(73) Assignee: i4F Licensing NV, Turnhout (BE)

( * ) Notice: Subject to any disclaimer, the term of this patent is extended or adjusted under 35 U.S.C. 154(b) by 176 days.

(21) Appl. No.: 18/788,610

(22) Filed: Jul. 30, 2024

(65) Prior Publication Data

US 2024/0384540 A1 Nov. 21, 2024

Related U.S. Application Data

(63) Continuation of application No. 18/167,332, filed on Feb. 10, 2023, now Pat. No. 12,084,870, which is a continuation of application No. 17/288,072, filed as application No. PCT/EP2019/076440 on Sep. 30, 2019, now Pat. No. 11,603,668.

(30) Foreign Application Priority Data

Oct. 26, 2018 (NL) ..... 2021884

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 2201/0146* (2013.01); *E04F 2201/0161* (2013.01); *E04F 2201/03* (2013.01); *E04F 2201/041* (2013.01); *E04F 2201/043* (2013.01)

(58) Field of Classification Search
CPC ..... E04F 15/02038; E04F 15/105; E04F 2201/0146; E04F 2201/023; E04F 2201/042; E04F 13/0894; E04F 2201/041; E04F 2201/03
See application file for complete search history.

(56) References Cited

U.S. PATENT DOCUMENTS 6,647,690 B1 11/2003 Martensson
2002/0100242 A1 8/2002 Olofsson
(Continued)

FOREIGN PATENT DOCUMENTS

CN 1334893 A 2/2002
CN 203924590 U 11/2014
(Continued)

*Primary Examiner* — Gisele D Ford
(74) *Attorney, Agent, or Firm* — The Webb Law Firm

(57) ABSTRACT

A panel, including a centrally located core provided with an upper side and a lower side, at least one first coupling part and at least one second coupling part connected respectively to opposite edges of the core, which first coupling part comprises an upward tongue, at least one upward flank lying at a distance from the upward tongue and an upward groove formed in between the upward tongue and the at least one upward flank, wherein a recessed portion is shaped like a triangle and the underside of the upward tongue is at an angle; wherein at least a part the side of the upward tongue facing away from the at least one upward flank is located at a distance from at least a part of the at least one upward flank; and wherein the recessed portion extends over at least 90% of the distance.

13 Claims, 5 Drawing Sheets

(56) References Cited

U.S. PATENT DOCUMENTS

| | | | | |
|---|---|---|---|---|
| 2005/0028474 | A1 | 2/2005 | Kim | |
| 2007/0266666 | A1 | 11/2007 | Dammers | |
| 2014/0033633 | A1 | 2/2014 | Kell | |
| 2018/0010342 | A1* | 1/2018 | Van Hooydonck ... | E04F 15/105 |
| 2018/0094441 | A1* | 4/2018 | Boo ..... | E04F 15/02038 |
| 2020/0063443 | A1 | 2/2020 | Bouckéet al. | |
| 2021/0002907 | A1 | 1/2021 | Boucké | |

FOREIGN PATENT DOCUMENTS

| | | | |
|---|---|---|---|
| DE | 102007042840 | A1 | 3/2009 |
| DE | 102011086846 | A1 | 8/2012 |
| DE | 202016102034 | U1 | 6/2016 |
| DE | 102016115886 | A1 | 3/2018 |
| WO | 2016113677 | A1 | 7/2016 |
| WO | 2017115202 | A1 | 7/2017 |
| WO | 2018063047 | A1 | 4/2018 |

* cited by examiner

PANEL, IN PARTICULAR A FLOOR OR WALL PANEL

CROSS-REFERENCE TO RELATED APPLICATIONS

This application is a continuation of U.S. patent application Ser. No. 18/167,332, filed Feb. 10, 2023, which is a continuation of U.S. patent application Ser. No. 17/288,072, filed Sep. 30, 2019, now U.S. Pat. No. 11,603,668, which is the United States national phase of International Application No. PCT/EP2019/076440 filed Sep. 30, 2019, and claims priority to The Netherlands Patent Application No. 2021884 filed Oct. 26, 2018, the disclosures of which are hereby incorporated by reference in their entireties.

BACKGROUND OF THE INVENTION

Field of the Invention

The present invention relates to a panel, in particular a floor panel or a wall panel.

Description of Related Art

The last decade has seen enormous advance in the market for laminate for hard floor covering. It is known to install floor panels on a underlying floor in various ways. It is, for example, known that the floor panels are attached at the underlying floor, either by gluing or by nailing them on. This technique has a disadvantage that is rather complicated and that subsequent changes can only be made by breaking out the floor panels. According to an alternative installation method, the floor panels are installed loosely onto the subflooring, whereby the floor panels mutually match into each other by means of a tongue and groove coupling, whereby mostly they are glued together in the tongue and groove, too. The floor obtained in this manner, also called a floating parquet flooring, has as an advantage that it is easy to install and that the complete floor surface can move which often is convenient in order to receive possible expansion and shrinkage phenomena. A disadvantage with a floor covering of the above-mentioned type, above all, if the floor panels are installed loosely onto the subflooring, consists in that during the expansion of the floor and its subsequent shrinkage, the floor panels themselves can drift apart, as a result of which undesired gaps can be formed, for example, if the glue connection breaks. In order to remedy this disadvantage, techniques have already been through of whereby connection elements made of metal are provided between the single floor panels in order to keep them together. Such connection elements, however, are rather expensive to make and, furthermore, their provision or the installation thereof is a time-consuming occupation. Floor panels having complementarily shaped coupling parts at opposing panel edges are also known. These known panels are typically rectangular and have complementarily shaped angling-down coupling parts at opposing long panel edges and complementarily shaped fold-down coupling parts at opposing short panel edges. Installation of these known floor panels is based upon the so-called fold-down technique, wherein the long edge of a first panel to be installed is firstly coupled to or inserted into the long edge of an already installed second panel in a first row, after which the short edge of the first panel is coupled to the short edge of an already installed third panel in a second row during lowering (folding down) the first panel, which installation fulfils the targeted requirement of a simple installation. In this manner a floor covering consisting of a plurality of parallel oriented rows of mutually coupled floor panels can be realized.

DE102016115886 for instance describes a plate-shaped component, in particular a floor panel. The component has a rectangularly configured panel plate which, on a first panel side, has a first locking strip protruding from the side surface of the panel plate on the top side in the plane of the upper side of the panel plate. The first locking strip has a downwardly open first coupling channel and a downwardly directed first coupling bead at the end. On the opposite, second panel side of the panel plate, a second locking strip is provided on the bottom and protrudes from the side surface of the panel plate located here. The second locking bar has an upwardly open second coupling channel and an upwardly directed second coupling bead at the end. WO2017/115202 for example describes a floor panel for forming a floor covering, wherein the floor covering consists of floor panels, which, on at least one pair of edges, are provided with coupling parts, that these coupling parts substantially are manufactured from the material of the floor panel, and that these coupling parts are configured such that two such floor panels, at said pair of edges, can be installed and locked to each other by means of a downward movement and/or by means of the fold-down principle.

SUMMARY OF THE INVENTION

It is an object of the invention to provide a panel, wherein multiple panels can be mutually coupled in an improved manner.

The invention thereto provides a panel, in particular a floor panel or wall panel, comprising: a centrally located core provided with an upper side and a lower side, which core defines a plane; at least one first coupling part and at least one second coupling part connected respectively to opposite edges of the core, which first coupling part comprises an upward tongue, at least one upward flank lying at a distance from the upward tongue and an upward groove formed in between the upward tongue and the upward flank wherein the upward groove is adapted to receive at least a part of a downward tongue of a second coupling part of an adjacent panel; which second coupling part comprises a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel; wherein at least a part of a side of the upward tongue facing away from the upward flank is provided with a first locking element, in the form of an outward bulge, adapted for co-action with a second locking element, in the form of a recess, of an adjacent panel; wherein at least a part of a side of the downward flank is provided with a second locking element, in the form of a recess, adapted for co-action with the first locking element in the form of an outward bulge, of an adjacent panel; wherein the lower part of the first coupling part that is located between a side of the upward tongue facing away from the upward flank and the upward flank is the bottom part of the first coupling part, and wherein the bottom part of the first coupling part comprises a recessed portion, in particular a recessed portion extending between the upward flank and the side of the upward tongue facing away from the upward flank; wherein the recessed portion is configured to allow downward movement of the upward tongue, into the recessed portion, during coupling of two adjacent panels, preferably such that the upward groove is temporarily widened to facilitate coupling of two panels. The side of the upward tongue facing away from the upward flank is located at a distance from the upward flank; wherein the distance is less than the thickness of the core; and wherein the recessed portion extends over at least 75% of the distance, and preferably extends over the complete distance.

The locking elements of the coupling parts contribute to the locking of coupled panels. The cooperation of the tongues and the grooves for instance contributes to a horizontal locking, or locking in the plane of the coupled panels. The first and second locking elements typically contribute either to the vertical locking, or locking in a plane perpendicular to the plane of the coupled panels, or they contribute to rotational locking, such that two panels cannot be swivelled free, or that such swivelling is reduced.

By having the distance between the outside of the upward tongue and the upward flank arranged to be less than the thickness of the core, a relative short protruding element is produced, which limits the vulnerability of the coupling parts. On the other hand, by having the recessed portion to extend over a large portion of the distance, several benefits may be achieved. For one, this allows for relative much material savings. The material which is removed in order to form the recessed portion can be recycled in new panels, and by removing more material, more material can be reintroduced in the system. Secondly, the relatively large recess allows a gradual bending of the upward tongue, as the bending can be spread out over a larger surface area.

Preferably, the recessed portion (17) extends over at least 75% of the greatest distance (D) definable between the upward flank (8) and the side of the upward tongue (7) facing away from the upward flank (8). Although it is imaginable that both the upward flank (8) and the side of the upward tongue (7) facing away from the upward flank (8) are completely vertically oriented, but in practice one or both of these sides could be inclined and/or could have a different, possibly contoured, shape. This leads to different distances (D) dependent on the way of measuring this distance, and therefore it is preferred to take the greatest distance (D) as reference to subsequently define the extension of the recessed portion. The distance (D) is measured in the plane defined by the panel, and hence the distance (D) is considered as a "horizontal distance". Preferably, the recessed portion (17) extends over at least 80%, preferably at least 85%, more preferably at least 90%, of the distance (D), preferably the greatest distance (D). The recessed portion is preferably an inclined recessed portion. The angle enclosed by the plane defined by the panel and the inclination of the recessed portion is preferably situated between 15 and 35 degrees, and is more preferably about 25 degrees (+/−1 or 2 degrees). It is advantageous in case the maximum height of the recessed portion is preferably at least 30% of the panel thickness and/or the core thickness. This provides significant space underneath the upward tongue to pivot in downward direction during the coupling process.

By providing the recessed portion between the flank and the outer side of the upward tongue, a space is created which can be taken up by tongue material during coupling. This temporary deflection of the tongue allows the upward groove to widen temporarily, which larger groove facilitates coupling of two panels into each other.

The recessed portion may for instance be formed by a milled out groove, that when the panel is placed on a horizontal subfloor or surface, also extends in horizontal direction. Alternatively, the groove extends from a distance of the bottom side of the panel.

The recessed portion may define an area between the panel and a surface on which the panel is arranged. The recessed portion may thus be provided on the bottom of the panel, and can for instance be provided by simply removing a piece of the bottom of the panel by conventional milling techniques.

The recessed portion may extend from the part of the side of the upward tongue facing away from the upward flank inwards, such that at the bottom of the side of the upward tongue facing away from the upward flank at least a part of the recessed portion is located. By having the recessed portion extend inwards from the outside of the upward tongue, a space is created underneath the outside of the upward tongue. It typically is this outside of the upward tongue that is deflected the most, given that it is at the end of the coupling part.

In cross sectional view of the panel, the recessed portion may have a substantially rectangular cross section. With cross sectional view, a view is intended that is taken along one of the main directions of the panel. Panels, or floor panels, tend to have a square or rectangular shape, wherein the cross sectional view is taken along one of the centre lines of the panel. Such shape is relatively easy to produce, for instance by milling out a portion of the panel with conventional milling techniques. This milled out part of the panel may be used as resource in the production of future panels.

The recessed portion may extends at least halfway from the part of the side of the upward tongue facing away from the upward flank to the vertical level of the upward flank. With vertical level of the upward flank is intended that the upward flank is arranged at a distance from the upward tongue, and the vertical level is a vertical line that crosses the upward flank. If the upward flank is inclined, and this has no single point to cross, the vertical level may be considered to be the vertical line that crosses the middle of the upward flank, wherein the middle is arranged between the two outer horizontal parts of the upward flank.

The inward transition from the recessed portion to the core of the panel may at least be partially curved, or the inward transition from the recessed portion to the core of the panel may be square. A curved transition of the recessed portion allows for a smooth transition between the recessed portion and the core, wherein forces exerted on the panel may be transferred rather smoothly as well. On the other hand, a square transition is relatively easy to manufacture.

The upper side of the upward tongue may be inclined, and runs downward from the side of the upward tongue facing toward the upward flank towards the side of the upward tongue facing away from the upward flank. Such inclined upper side of the tongue allows for more margin of panels in coupled condition. At least a part of the bottom side of the downward groove may also be inclined compared to the plane of the panel, and, preferably, the complete bottom side of the downward groove may be inclined. This has the result that the thickness of the upward tongue decreases in the direction of the side of the tongue facing away from the upward flank. By having the downward groove substantially connect to the upper side of the upward tongue, in a coupled position of two panels according to the invention wherein an upper side of the downward groove extends in the direction of the normal of the lower side of the core, a second coupling part can be provided which is on the one hand relatively strong and solid and can on the other guarantee sufficient resilience to enable a coupling to be realized to a first coupling part of an adjacent floor panel. Additionally, this inclination forms a coupling part with varying thickness, wherein a part of the coupling parts will have a minimal thickness, or thinnest zone. This zone is most prone to elastic deformation, such that during coupling the location of deformation can be determined and set on forehand.

At least a part of the side of the upward tongue is inclined towards the upward flank, wherein the angle enclosed between the plane of the panel and the inclined part of the side of the upward tongue facing the upward flank lies between 90 and 45 degrees, in particular between 90 and 60 degrees, more in particular between 90 and 80 degrees. This inclination of the side of the upward tongue, which typically is the side of the upward tongue facing towards the upward flank, results in a so-called "closed-groove" locking system. In this arrangement, the 90 degree value of the claim is not part of the range. The claimed ranges indicate that the angle between the inclined part and the vertical are between 0 and 45 degrees, in particular 0 and 30 degrees, and more in particular between 0 and 10 degrees. As an exemplary value, this angle is about 2.5 degrees, which is thus the amount or value to which extent the inclined part is inclined inwards, towards the core. Such closed groove system is relatively difficult to coupled, since the coupling parts will need to at least temporarily deform during coupling. The benefit of such system however is that the inclined parts do contribute to a vertical locking of panels in coupled condition.

At least a part of the side of the upward tongue may be inclined away from the upward flank, wherein the angle enclosed between the plane of the panel and the inclined part of the side of the upward tongue facing the upward flank lies between 90 and 180 degrees, in particular between 90 and 120 degrees, more in particular between 90 and 100 degrees. This results in a so-called "open-groove" system. Compared to the closed groove system, such open groove systems are relatively easy to couple.

A part of a side of the downward tongue facing away from the downward flank may be provided with a third locking element, for instance in the form of an outward bulge or a recess, adapted for co-action with a fourth locking element, for instance in the form of a recess or an outward bulge, of an adjacent panel; and at least a part of the upward flank may be provided with a fourth locking element, for instance in the form of a recess or an outward bulge, adapted for co-action with the third locking element, for instance in the form of an outward bulge or a recess, of an adjacent panel. These additional locking elements are typically provided to increase either the vertical locking of coupled panels, or increase the swivel resistance of two coupled panels.

Instead of the first and second locking elements, the panel may comprise the third and fourth locking elements. Here, the third and fourth locking elements replace the first and second locking elements, meaning that the locking elements are arranged on different parts of the coupling parts compared to the previous embodiments.

The first coupling part may comprise a first bridge part, arranged between the core and the upward tongue, and the second coupling part may comprise a second bridge part, arranged between the core and the downward tongue. The first bridge part may comprise a weakened zone of reduced thickness, to facilitate deformation of the first bridge part during coupling and/or the second bridge part may comprise a weakened zone of reduced thickness, to facilitate deformation of the second bridge part during coupling. By defining a weakest or thinnest zone, the area or the location where deformation is most likely to occur during coupling can be appointed, or designed. This allows for a prediction of the location where deformation is most likely to occur, and thus allows calculation and designing the optimal thickness of the panel at said location.

During coupling the upward tongue may bend downward into the recessed portion, and then returns, at least partially, towards its initial position. In coupled position the upward tongue may remain bend downwards at least partially compared to its initial position, and in coupled position the coupling parts may exert a locking force onto the panels, forcing the panels towards each other under a tension force exerted by at least one of the coupling parts. This tension force forces coupled panels together, or towards each other, and thus increases the locking of coupled panels. The amount of bend in coupled condition may be very small to achieve the effect. Compared to the initial position, the upward tongue is bend downwards and is thus arranged lower. The difference in height between the initial position and the bend position may be between 0.1 and 5 mm, typically between 0.2 and 2 mm. The difference may also be in the order of 0.05-1 mm.

Preferably, at least a part of the first coupling part and/or at least a part of second coupling part of each panel is integrally connected to the core layer. In this case one-piece panels are formed, which are relatively easy and cost-efficient to produce.

The panel according to the invention may be rigid or may be flexible (resilient), or slightly flexible (semi-rigid). Each panel panels are typically is made as one of the following kinds: as a laminate floor panel; as a so-called "resilient floor panel"; a "LVT" (luxury vinyl panel) panel or "VCT panel" (vinyl composition panel) or comparable thereto panel on the basis of another synthetic material than vinyl; a floor panel with a first synthetic material-based, preferably foamed, substrate layer (core layer), with thereon a preferably thinner second substrate layer (second core layer) of or on the basis of vinyl or another synthetic material; as a floor panel with a hard synthetic material-based substrate. In case a relatively rigid material is used for manufacturing the panel, and in particular the coupling parts, the material should allow (slight) deformation in order to couple adjacent panels in such a way that a pretension will be created between the coupled coupling parts of said panels.

The panel may be made such that the first coupling part and the second coupling part are configured such that in coupled condition a pretension is existing, which forces the respective panels at the respective edges towards each other, wherein this preferably is performed by applying overlapping contours of the first coupling part and the second coupling part, in particular overlapping contours of the downward tongue and the upward groove and/or overlapping contours of the upward tongue and the downward groove, and wherein the first coupling part and the second coupling part are configured such that the two of such panels can be coupled to each other by means of a fold-down movement and/or a vertical movement, such that, in coupled condition, wherein, in coupled condition, at least a part of the downward tongue of the second coupling part is inserted in the upward groove of the first coupling part, such that the downward tongue is clamped by first coupling part, such that at least a part of the second coupling part is clamped by the first coupling part and/or at least a part of the first coupling part is clamped by the second coupling part.

The pretension referred to means that the coupling parts exert forces onto each other in coupled condition, which are such that the coupling parts, and hence the respective panels at the respective edges are forced (pushed) towards each other, wherein the first coupling part and the complementary second coupling part mutually cooperate in a clamping manner. This will significantly improve the stability and reliability of the coupling of the first coupling part and the second coupling part, and will prevent the coupling parts from drifting apart (which would create a gap in between adjacent panels), while maintaining the big advantage that the panels are configured to be coupled by means of a fold-down movement and/or vertical movement, also referred to as a scissoring movement or zipping movement, and hence by using the user-friendly fold-down technology. The pretension is preferably realized by using overlapping contours of the first coupling part and the second coupling part, in particular overlapping contours of the downward tongue and the upward groove and/or overlapping contours of the upward tongue and the downward groove. Overlapping contours doesn't mean that the complete contour should overlap, and merely requires that at least of part of the (outer) contour of the first coupling part overlaps with at least a part of the (outer) contour of the second coupling part. The contours are typically compared by considering the contours of the first coupling part and the second coupling part from a side view (or cross-sectional view). By applying overlapping contours, the first coupling part and/or the second coupling part will typically remain (elastically) deformed, in particular squeezed and/or bent, in a coupled state, provided the desired stability of the coupling. Normally, with overlapping contours the downward tongue will be (slightly) oversized with respect to the upward groove, and/or the upward tongue will be (slightly) oversized with respect to the downward groove. However, it should be understood that overlapping contours may also be realized in another manner, for example by applying overlapping first and second locking elements.

During coupling of the panels, the upward tongue may be (elastically) deformed, in particular squeezed and/or bent. Bending will take place from its initial position (slightly) in outward direction, away from the upward flank. A bent state of the upward tongue may remain in the coupled state of two panels. The bending angle of the proximal side of the upward tongue, facing the upward flank, will commonly be restricted and situated in between 0 and 2 degrees.

The oversize should be sufficiently large to realize the desired pretension, which pretension normally takes place already at a minimum oversize, though should at the other hand preferably be sufficiently limited to allow and secure proper and user-friendly installation. Preferably, the width of the downward tongue is oversized with respect to the width of the upward groove. This oversize is typically in the order magnitude of 0.05-0.5 mm. The maximum width of the downward tongue preferably exceeds the maximum width of the upward groove. This will commonly further contribute to keeping the panels push to each other to keep the coupling, and hence the seam, as tight (free of play) as possible. In order to secure the panels in a single (horizontal) plane, it is advantageous in case the height of the downward tongue is equal to or smaller than the height of the upward groove.

As already indicated, it is also conceivable that the upward tongue is oversized with respect to the downward groove. Preferably, the width of the upward tongue is oversized with respect to the width of the downward groove. Here, it is more preferred the maximum width of the upward tongue exceeds the maximum width of the downward groove, which also leads to pretension between the first coupling part and second coupling part. However, in this case it is preferred that the downward groove is not widened during coupling, or at least does not remain widened in coupled condition, in order to secure a tight seam between the panels and the prevent an offset between the panels. In case the panels edges are chamfered, in particular bevelled, a small offset will not be visible though, which therefore allow a small offset (due to (slight) widening of the downward groove and upward bending of the downward tongue in coupled condition). The height of the upward tongue is preferably equal to or smaller than the height of the downward groove. This will facilitate the keep coupled panels are the same level (within a joint (horizontal plane).

The core may be formed of a single material (single core layer). However, typically, the core comprises a plurality of core layers. Different core layers may have the same composition, although it is more preferred that at least two different core layers have different compositions, in order to improve the overall properties of the core. At least one core layer may be made of a composite of at least one polymer and at least one non-polymeric material. The composite of the core layer preferably comprises one or more fillers, wherein at least one filler is selected from the group consisting of: talc, chalk, wood, calcium carbonate, titanium dioxide, calcined clay, porcelain, a (nother) mineral filler, and a (nother) natural filler. The filler may be formed by fibres and/or may be formed by dust-like particles. Here, the expression "dust" is understood as small dust-like particles (powder), like wood dust, cork dust, or non-wood dust, like mineral dust, stone powder, in particular cement. The average particle size of the dust is preferably between 14 and 20 micron, more preferably between 16 and 18 micron. The primary role of this kind of filler is to provide the core layer sufficient hardness. This will typically also improve the impact strength of the core layer and of the panel(s) as such. The weight content of this kind of filler in the composite is preferably between 35 and 75%, more preferably between 40 and 48% in case the composite is a foamed (expanded) composite, and more preferably between 65 and 70% in case the composite is a non-foamed (solid) composite.

Polymer materials suitable for forming at least a part of at least one core layer may include polyurethane (PUR), polyamide copolymers, polystyrene (PS), polyvinyl chloride (PVC), polypropylene, polyethylene terephthalate (PET), polyisocyanurate (PIR), and polyethylene (PE) plastics, all of which have good moulding processability. The at least one polymer included in the core layer may either may be solid or may be foamed (expanded). Preferably, chlorinated PVC (CPVC) and/or chlorinated polyethylene (CPE) and/or another chlorinated thermoplastic material is/are used to further improve the hardness and rigidity of the core layers, and of the panels as such, reducing the vulnerability of the—optionally pointed—corners of each panel. Polyvinyl chloride (PVC) materials are especially suitable for forming the core layer because they are chemically stable, corrosion resistant, and have excellent flame-retardant properties. The plastic material used as plastic material in the core layer is preferably free of any plasticizer in order to increase the desired rigidity of the core layer, which is, moreover, also favourable from an environmental point of view.

The core layer may also at least partially be composed of a, preferably PVC-free, thermoplastic composition. This thermoplastic composition may comprise a polymer matrix comprising (a) at least one ionomer and/or at least one acid copolymer; and (b) at least one styrenic thermoplastic polymer, and, optionally, at least one filler. An ionomer is understood as being a copolymer that comprises repeat units of electrically neutral and ionized units. Ionized units of ionomers may be in particular carboxylic acid groups that are partially neutralized with metal cations. Ionic groups, usually present in low amounts (typically less than 15 mol % of constitutional units), cause micro-phase separation of ionic domains from the continuous polymer phase and act as physical crosslinks. The result is an ionically strengthened thermoplastic with enhanced physical properties compared to conventional plastics.

In an alternative configuration of the panel according to the invention, the panel comprises a substantially rigid core layer at least partially made of a non-foamed (solid) composite comprising at least one plastic material and at least one filler. A solid core layer may lead to an improved panel strength, and hence a reduced vulnerability of the pointed vertexes, and may further improve the suitability to use the panels to realize a chevron pattern. A drawback of applying a solid composite in the core layer instead of a foamed composite in the core layer is that the panel weight will increase (in case core layers of identical thicknesses would be applied), which may lead to higher handling costs, and higher material costs.

Preferably, the composite of the core layer comprises at least one filler of the core layer is selected from the group consisting of: a salt, a stearate salt, calcium stearate, and zinc stearate. Stearates have the function of a stabilizer, and lead to a more beneficial processing temperature, and counteract decomposition of components of the composite during processing and after processing, which therefore provide long-term stability. Instead of or in addition to a stearate, for example calcium zinc may also be used as stabilizer. The weight content of the stabilizer(s) in the composite will preferably be between 1 and 5%, and more preferably between 1.5 and 4%.

The composite of the core layer preferably comprises at least one impact modifier comprising at least one alkyl methacrylates, wherein said alkyl methacrylate is preferably chosen from the group consisting of: methyl methacrylate, ethyl methacrylate, propyl methacrylate, isopropyl methacrylate, t-butyl methacrylate and isobutyl methacrylate. The impact modifier typically improves the product performance, in particular the impact resistance. Moreover, the impact modifier typically toughens the core layer and can therefore also be seen as toughening agent, which further reduces the risk of breakage.

Often, the modifier also facilitates the production process, for example, as already addressed above, in order to control the formation of the foam with a relatively consistent (constant) foam structure. The weight content of the impact modifier in the composite will preferably be between 1 and 9%, and more preferably between 3 and 6%. Preferably, the substantially complete core layer is formed by either a foamed composite or a non-foamed (solid) composite. At least one plastic material used in the core layer is preferably free of any plasticizer in order to increase the desired rigidity of the core layer, which is, moreover, also favourable from an environmental point of view.

The core layer and/or another layer of the panel may comprise wood-based material, for example, MDF, HDF, wood dust, prefabricated wood, more particularly so-called engineered wood. This wood-based material may be part of a composite material of the core layer.

The density of the core layer typically varies from about 0.1 to 1.5 grams/cm3, preferably from about 0.2 to 1.4 grams/cm3, more preferably from about 0.3 to 1.3 grams/cm3, even more preferably from about 0.4 to 1.2 grams/cm3, even more preferably from about 0.5 to 1.2 grams/cm3, and most preferably from about 0.6 to 1.2 grams/cm3.

The polymer used in the core layer and/or the core layer as such preferably has an elastic modulus of more than 700 MPa (at a temperature of 23 degrees Celsius and a relative humidity of 50%). This will commonly sufficiently rigidity to the core layer, and hence to the parallelogrammatic/rhombic panel as such.

Preferably, the core layer comprises at least one foaming agent. The at least one foaming agent takes care of foaming of the core layer, which will reduce the density of the core layer. This will lead to light weight panels, which are lighter weight in comparison with panel which are dimensionally similar and which have a non-foamed core layer. The preferred foaming agent depends on the (thermo) plastic material used in the core layer, as well as on the desired foam ratio, foam structure, and preferably also the desired (or required) foam temperature to realise the desired foam ratio and/or foam structure. To this end, it may be advantageous to apply a plurality of foaming agents configured to foam the core layer at different temperatures, respectively. This will allow the foamed core layer to be realized in a more gradual, and more controller manner. Examples of two different foaming agents which may be present (simultaneously) in the core layer are azidicarbonamide and sodium bicarbonate. In this respect, it is often also advantageous to apply at least one modifying agent, such as methyl methacrylate (MMA), in order to keep the foam structure relatively consistent throughout the core layer.

It is conceivable that at least a part of the core is composed of a composition free of synthetic polymer, and possibly free of any polymer. To this end, the core may be at least partially composed of wood and/or mineral material, like magnesium oxide.

The core preferably has a thickness of at least 3 mm, preferably at least 4 mm, and still more preferably at least 5 mm. The panel thickness is typically situated in between 3 and 10 mm, preferably in between 4 and 8 mm.

The density of the core preferably varies along the height of the core. This may positively influence the acoustic (sound-dampening) properties of the panels as such. Preferably, at a top section and/or a bottom section of at least one foamed core layer a crust layer may be formed. This at least one crust layer may form integral part of the core layer. More preferably, both the top section and the bottom section of the core layer form a crust layer enclosing the foam structure. The crust layer is a relatively closed (reduced porosity, preferably free of bubbles (cells)), and hence forms a relatively rigid (sub)layer, compared to the more porous foam structure. Commonly, though not necessary, the crust layer is formed by sealing (searing) the bottom and top surface of the core layer. Preferably the thickness of each crust layer is between 0.01 and 1 mm, preferably between 0.1 and 0.8 mm. A too thick crust will lead to a higher average density of the core layer which increases both the costs and the rigidity of the core layer. The thickness of the core layer (core layer) as such is preferably between 2 and 10 mm, more preferably between 3 and 8 mm, and is typically approximately 4 or 5 mm. Preferably, a top section and/or a bottom section of the (composite) core layer forms a crust layer having a porosity which is less than the porosity of the closed cell foam plastic material of the core layer, wherein the thickness of each crust layer is preferably between 0.01 and 1 mm, preferably between 0.1 and 0.8 mm.

Preferably, each panel comprises at least one backing layer affixed to a bottom side of the core layer, wherein said at least one backing layer at least partially made of a flexible material, preferably an elastomer. The thickness of the backing layer typically varies from about 0.1 to 2.5 mm. Non-limiting examples of materials whereof the backing layer can be made of are polyethylene, cork, polyurethane and ethylene-vinyl acetate. The thickness of a polyethylene backing layer is for example typically 2 mm or smaller. The backing layer commonly provides additional robustness and impact resistances to each panel as such, which increases the durability of the panels. Moreover, the (flexible) backing layer may increase the acoustic (sound-dampening) properties of the panels. In a particular embodiment, the core layer is composed of a plurality of separate core layer segments affixed to said at least one backing layer, preferably such that said core layer segments are mutually hingeable. The lightweight features of the panels are advantageous for obtaining a secure bond when installing the panel on vertical wall surfaces. It is also especially easy to install the panel at vertical corners, such as at inside corners of intersecting walls, pieces of furniture, and at outside corners, such as at entry ways. An inside or outside corner installation is accomplished by forming a groove in the core layer of the panel to facilitate bending or folding of the panel.

Each panel may comprises at least one reinforcing layer. At least one reinforcing layer may be situated in between the core and an upper substrate affixed to the core. At least one reinforcing layer may be situated in between two core layers. The application of a reinforcing layer may lead to further improvement of the rigidity of the panel as such. This may also lead to improvement of the acoustic (sound-dampening) properties of the panels. The reinforcement layer may comprise a woven or non-woven fibre material, for example a glass fibre material. They may have a thickness of 0.2-0.4 mm. It is also conceivable that each panel comprises a plurality of the (commonly thinner) core layer stacked on top of each other, wherein at least one reinforcing layer is situated in between two adjacent core layers. Preferably, the density of the reinforcing layer is preferably situated between 1.000 and 2.000 kg/m3, preferably between 1.400- and 1.900 kg/m3, and more preferably between 1.400-1.700 kg/m3.

Each panel preferably comprises an upper substrate affixed—directly or indirectly—to an upper side the core, wherein said upper substrate preferably comprises a decorative layer. The upper substrate is preferably at least partially made of at least one material selected from the group consisting of: metals, alloys, macromolecular materials such as vinyl monomer copolymers and/or homopolymers; condensation polymers such as polyesters, polyamides, polyimides, epoxy resins, phenol-formaldehyde resins, urea formaldehyde resins; natural macromolecular materials or modified derivatives thereof such as plant fibres, animal fibres, mineral fibres, ceramic fibres and carbon fibres. Here, the vinyl monomer copolymers and/or homo-polymers are preferably selected from the group consisting of polyethylene, polyvinyl chloride (PVC), polystyrene, polymethacrylates, polyacrylates, polyacrylamides, ABS, (acrylonitrile-butadiene-styrene) copolymers, polypropylene, ethylene-propylene copolymers, polyvinylidene chloride, polytetrafluoroethylene, polyvinylidene fluoride, hexafluoropropene, and styrene-maleic anhydride copolymers, and derivates thereof. The upper substrate most preferably comprises polyethylene or polyvinyl chloride (PVC). The polyethylene can be low density polyethylene, medium density polyethylene, high density polyethylene or ultra-high density polyethylene. The upper substrate layer can also include filler materials and other additives that improve the physical properties and/or chemical properties and/or the processability of the product. These additives include known toughening agents, plasticizing agents, reinforcing agents, anti-mildew (antiseptic) agents, flame-retardant agents, and the like. The upper substrate typically comprises a decorative layer and an abrasion resistant wear layer covering said decorative layer, wherein a top surface of said wear layer is the top surface of said panel, and wherein the wear layer is a transparent material, such that decorative layer is visible through the transparent wear layer.

The thickness of the upper substrate typically varies from about 0.1 to 3.5 mm, preferably from about 0.5 to 3.2 mm, more preferably from about 1 to 3 mm, and most preferably from about 2 to 2.5 mm. The thickness ratio of the core layer to the upper substrate commonly varies from about 1 to 15:0.1 to 3.5, preferably from about 1.5 to 10:0.5 to 3.2, more preferably from about 1.5 to 8:1 to 3, and most preferably from about 2 to 8:2 to 2.5, respectively.

Each panel may comprise an adhesive layer to affix the upper substrate, directly or indirectly, onto the core layer. The adhesive layer can be any well-known bonding agent or binder capable of bonding together the upper substrate and the core layer, for example polyurethanes, epoxy resins, polyacrylates, ethylene-vinyl acetate copolymers, ethylene-acrylic acid copolymers, and the like. Preferably, the adhesive layer is a hot-melt bonding agent.

The decorative layer or design layer, which may be part of the upper substrate as mentioned above, can comprise any suitable known plastic material such as a known formulation of PVC resin, stabilizer, plasticizer and other additives that are well known in the art. The design layer can be formed with or printed with printed patterns, such as wood grains, metal or stone design and fibrous patterns or three-dimensional figures. Thus the design layer can provide the panel with a three dimensional appearance that resembles heavier products such as granite, stone or metal. The thickness of the design layer typically varies from about 0.01 to 0.1 mm, preferably from about 0.015 to 0.08 mm, more preferably from about 0.2 to 0.7 mm, and most preferably from about 0.02 to 0.5 mm. The wear layer that typically forms the upper surface of the panel can comprise any suitable known abrasion-resistant material, such as an abrasion-resistant macromolecular material coated onto the layer beneath it, or a known ceramic bead coating. If the wear layer is furnished in layer form, it can be bonded to the layer beneath it. The wear layer can also comprise an organic polymer layer and/or inorganic material layer, such as an ultraviolet coating or a combination of another organic polymer layer and an ultraviolet coating. For example, an ultraviolet paint capable of improving the surface scratch resistance, glossiness, antimicrobial resistance and other properties of the product. Other organic polymers including polyvinyl chloride resins or other polymers such as vinyl resins, and a suitable amount of plasticizing agent and other processing additives can be included, as needed.

The panel may comprise a plurality of first coupling parts and a plurality of second coupling parts. More in particular, each panel edge may be provided with either a first coupling or a second coupling part. Preferably, the first coupling part and/or the second coupling part are made of a flexible material, a semi-rigid material, and/or a rather rigid material which stills exhibits sufficient deformation to allow smooth coupling and the creation of pretension between the coupling parts in coupled state.

The panel according to the invention typically has a square, rectangular, triangular, hexagon, octagon, or other polygonal shape. However, other shapes, like a parallelogramical shape, are also imaginable. Preferably, in case of a panel with an even number of edges, the number of first coupling parts equals the number of second coupling parts. In case the panel has a parallelogramical shape, two pairs of adjacent edges enclose an acute angle, and wherein two pairs of other adjacent edges enclose a obtuse angle.

These panels allow the creation of a so-called chevron pattern. The acute angle is typically situated between 30 and 60 degrees, and is preferably substantially 45 degrees. The obtuse angle is typically situated between 120 and 150 degrees, and is preferably substantially 135 degrees.

Preferably, for creating a chevron pattern, two different types of panels (A and B respectively), both according to the invention, are used, wherein the coupling parts of one panel type (A) are arranged in a mirror-inverted manner relative to the corresponding coupling parts of the other panel type (B). Distinctive visual markings, for example coloured labels, symbolic labels, (pre-attached) differently coloured backing layers, and/or text labels, may be applied to different panel types to allow a user to easily recognize the different panels types during installation. Preferably the visual markings are not visible in a coupled condition of the panels (from a top view). A visual marking may, for example, be applied onto the upper side of the upward tongue and/or inside the upward groove and/or inside the downward groove. It is imaginable that a covering, consisting of panels according to the invention, comprises more than two different types of panels.

The coupling parts are preferably made of a material that is able to deform or compress at least partially during coupling.

The panels according to the invention may also be referred to as tiles or boards. The core layer may also be referred to as substrate. The coupling parts may also be referred to as coupling profiles, locking profiles or as connecting profiles. By "complementary" coupling parts is meant that these coupling parts can cooperate with each other. However, to this end, the complementary coupling parts do not necessarily have to have complementary forms. By locking in "vertical direction" is meant locking in a direction perpendicular to the plane of the panel. By locking in "horizontal direction" is meant locking in a direction perpendicular to the respective coupled edges of two panels and parallel to or falling together with the plane defined by the panels. In case in this document reference is made to a "floor panel" or "floor panel", these expressions may be replaced by expressions like "panel", "wall panel", "ceiling panel", "covering panel". In the context of this document, the expressions "foamed composite" and "foamed plastic material" (or "foam plastic material") are interchangeable, wherein in fact the foamed composite comprises a foamed mixture comprising at least one (thermos) plastic material and at least one filler (non-polymeric material).

Further non-limitative embodiments of the invention are set out in the clauses presented below:

1. Panel (1), in particular a floor panel or wall panel, comprising:
   - a centrally located core (2) provided with an upper side (2*a*) and a lower side (2*b*), which core (2) defines a plane (P);
   - at least one first coupling part (3) and at least one second coupling part (4) connected respectively to opposite edges (5, 6) of the core (2),
   - which first coupling part (3) comprises an upward tongue (7), at least one upward flank (8) lying at a distance from the upward tongue and an upward groove (9) formed in between the upward tongue (7) and the upward flank (8) wherein the upward groove (9) is adapted to receive at least a part of a downward tongue (10) of a second coupling part (4) of an adjacent panel (1):
   - which second coupling part (4) comprises a downward tongue (10), at least one downward flank (11) lying at a distance from the downward tongue (10), and a downward groove (12) formed in between the downward tongue (10) and the downward flank (11), wherein the downward groove (12) is adapted to receive at least a part of an upward tongue (7) of a first coupling part (3) of an adjacent panel (1);
   - wherein at least a part of a side (13) of the upward tongue (7) facing away from the upward flank (8) is provided with a first locking element (14), for instance in the form of an outward bulge (14) or a recess, adapted for co-action with a second locking element (15), for instance in the form of a recess (15) or an outward bulge, of an adjacent panel (1);
   - wherein at least a part of a side of the downward flank (11) is provided with a second locking element (15), for instance in the form of a recess (15) or an outward bulge, adapted for co-action with the first locking element (14) of an adjacent panel (1);
   - wherein the lower part of the first coupling part (7) that is located between a side (13) of the upward tongue (7) facing away from the upward flank (8) and the upward flank (8) is the bottom part (16) of the first coupling part (7), and
   - wherein the bottom part (16) of the first coupling part (7) comprises a recessed portion (17), in particular a recessed portion (17) extending between the upward flank (8) and the side (13) of the upward tongue (7) facing away from the upward flank (8);
   - wherein the recessed portion (17) is configured to allow downward movement of the upward tongue (7), into the recessed portion (17), during coupling of two adjacent panels (1), preferably such that the upward groove (9) is temporarily widened to facilitate coupling of two panels (1).
2. Panel (1) according to clause 1, wherein the recessed portion (17) defines an area between the panel (1) and a surface on which the panel (1) is arranged.
3. Panel (1) according to any of the preceding clauses, wherein the recessed portion (17) extends from the part of the side (13) of the upward tongue (7) facing away from the upward flank (8) inwards, such that at the bottom (18) of the side (13) of the upward tongue (7) facing away from the upward flank (8) at least a part of the recessed portion (17) is located.
4. Panel (1) according to any of the preceding clauses, wherein, in cross sectional view of the panel (1), the recessed portion (17) has a substantially rectangular cross section.
5. Panel (1) according to any of the preceding clauses, wherein the recessed portion (17) extends at least halfway the distance (D) from the part of the side (13) of the upward tongue (7) facing away from the upward flank (8) to the vertical level (V) of the upward flank (8).
6. Panel (1) according to any of the preceding clauses, wherein the inward transition (19) from the recessed portion (17) to the core (2) of the panel (1) is at least partially curved, or wherein the inward transition (19) from the recessed portion (17) to the core (2) of the panel (1) is square.
7. Panel (1) according to any of the preceding clauses, wherein the upper side (20) of the upward tongue (7) is inclined, and runs downward from the side (21) of the upward tongue (7) facing toward the upward flank (8)

towards the side (13) of the upward tongue (7) facing away from the upward flank (8).

8. Panel (1) according to any of the preceding clauses, wherein at least a part of the side (21) of the upward tongue (7) is inclined towards the upward flank 8), wherein the angle (α) enclosed between the plane (P) of the panel (1) and the inclined part of the side (21) of the upward tongue (7) facing the upward flank (8) lies between 90 and 45 degrees, in particular between 90 and 60 degrees, more in particular between 90 and 80 degrees.
9. Panel (1) according to any of the preceding clauses, wherein at least a part of the side (21) of the upward tongue (7) is inclined away from the upward flank (8), wherein the angle enclosed between the plane (P) of the panel (1) and the inclined part of the side (21) of the upward tongue (7) facing the upward flank (8) lies between 90 and 180 degrees, in particular between 90 and 120 degrees, more in particular between 90 and 100 degrees.
10. Panel (1) according to any of the preceding clauses, wherein a part of a side (22) of the downward tongue (10) facing away from the downward flank (11) is provided with a third locking element (23), for instance in the form of an outward bulge (23) or a recess, adapted for co-action with a fourth locking element (24), for instance in the form of a recess (24) or an outward bulge, of an adjacent panel (1); and wherein at least a part of the upward flank (8) is provided with a fourth locking element (24), for instance in the form of a recess (24) or an outward bulge, adapted for co-action with the third locking element (23) of an adjacent panel (1).
11. Panel (1) according to clause 10, wherein instead of the first (14) and second (15) locking elements, the panel comprises the third (23) and fourth (24) locking elements.
12. Panel (1) according to any of the preceding clauses, wherein the first coupling part (3) comprises an first bridge part (25), arranged between the core (2) and the upward tongue (7), and wherein the second coupling part (4) comprises a second bridge part (26), arranged between the core (2) and the downward tongue (10), wherein the first bridge part (25) comprises a weakened zone of reduced thickness, to facilitate deformation of the first bridge part (25) during coupling and/or wherein the second bridge part (26) comprises a weakened zone (27) of reduced thickness, to facilitate deformation of the second bridge part (26) during coupling.
13. Panel (1) according to any of the preceding clauses, wherein during coupling the upward tongue (7) bends downward into the recessed portion (17), and then returns towards its initial position.
14. Panel (1) according to clause 13, wherein in coupled position the upward tongue (7) remains bend downwards at least partially compared to its initial position, and wherein in coupled position the coupling parts (7, 8) exert a locking force onto the panels (1), forcing the panels (1) towards each other under a tension force exerted by at least one of the coupling parts (7, 8).
15. Panel (1) according to any of the preceding clauses, wherein the first coupling part (3) and the second coupling part (4) are configured such that in coupled condition a pretension is existing, which forces the respective panels (1) at the respective edges (5, 6) towards each other, wherein this is performed by applying overlapping contours of the first coupling part (3) and the second coupling part (4), in particular overlapping contours of the downward tongue (10) and the upward groove (9) and/or overlapping contours of the upward tongue (7) and the downward groove (12), and wherein the first coupling part (3) and the second coupling part (4) are configured such that the two of such panels (1) can be coupled to each other by means of a fold-down movement and/or a vertical movement, wherein, in coupled condition, at least a part of the downward tongue (10) of the second coupling part (4) is inserted in the upward groove (9) of the first coupling part (3), such that the downward tongue (10) is clamped by the first coupling part (3) and/or the upward tongue (7) is clamped by the second coupling part (4).

BRIEF DESCRIPTION OF THE DRAWINGS

The invention will be elucidated on the basis of non-limitative exemplary embodiments shown in the following figures, wherein.

DESCRIPTION OF THE INVENTION

The features as shown in the figures are interchangeable between the embodiments, unless otherwise indicated.

Figure 1:
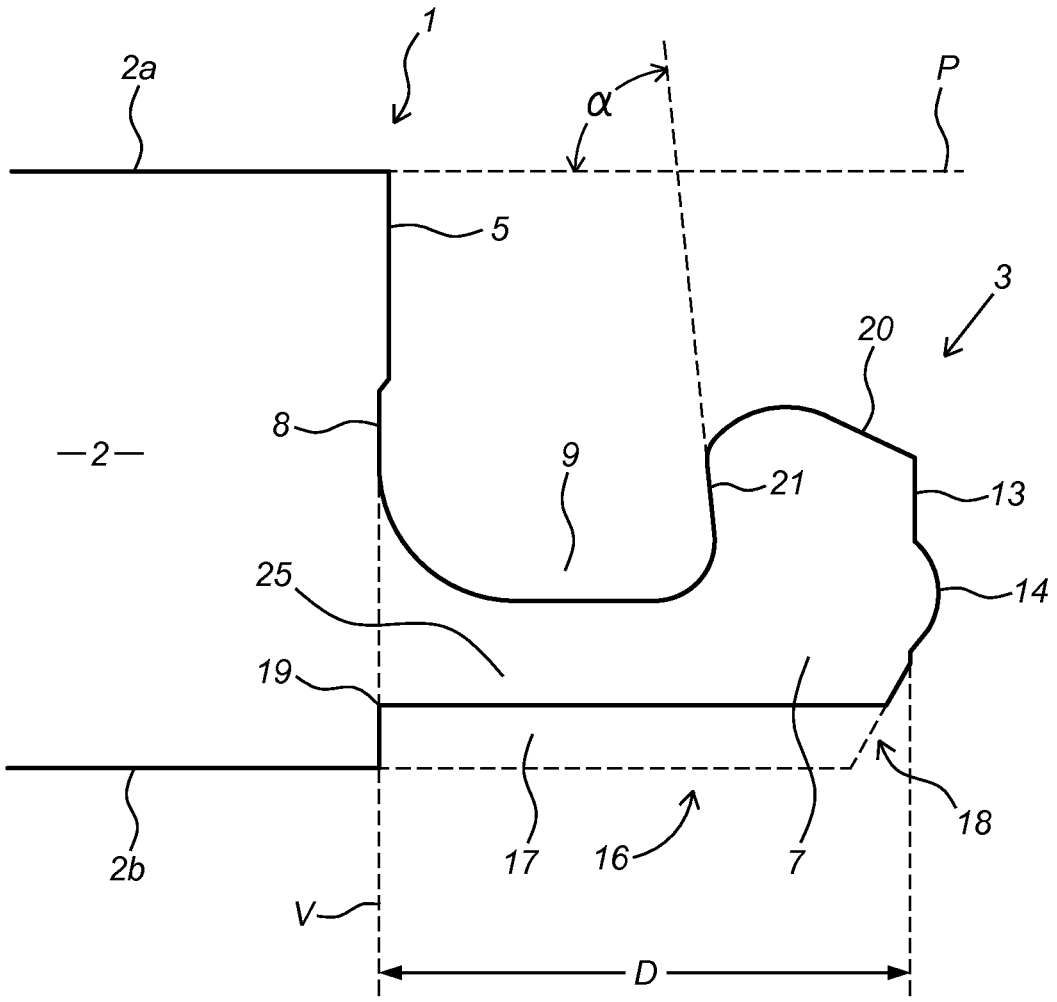
FIG. 1 schematically shows first coupling part according to the invention in a first embodiment.

FIG. 1 schematically shows a panel (1) with the first coupling part (3). FIG. 1 shows the panel (1), with a centrally located core (2) provided with an upper side (2*a*) and a lower side (2*b*), which core (2) defines a plane (P). FIG. 1 shows one of the opposite edges (5), with a first coupling part (3). This first coupling part (3) comprises an upward tongue (7), one upward flank (8) lying at a distance from the upward tongue and an upward groove (9) formed in between the upward tongue (7) and the upward flank (8). The upward groove (9) is adapted to receive at least a part of a downward tongue (10) of a second coupling part (4) of an adjacent panel (1), which elements are indicated in another figure. A side (13) of the upward tongue (7) facing away from the upward flank (8) is provided with a first locking element (14), in the form of an outward bulge adapted for co-action with a second locking element (15), in the form of a recess (15) of an adjacent panel (1). The lower part of the first coupling part (7) that is located between a side (13) of the upward tongue (7) facing away from the upward flank (8) and the upward flank (8) is the bottom part (16) of the first coupling part (7), and the bottom part (16) of the first coupling part (7) comprises a recessed portion (17) extending between the upward flank (8) and the side (13) of the upward tongue (7) facing away from the upward flank (8).

The recessed portion (17) extends from the part of the side (13) of the upward tongue (7) facing away from the upward flank (8) inwards, such that at the bottom (18) of the side (13) of the upward tongue (7) facing away from the upward flank (8) at least a part of the recessed portion (17) is located. The recessed portion (17) in FIG. 1 extends over the full distance (D) from the part of the side (13) of the upward tongue (7) facing away from the upward flank (8) to the vertical level (V) of the upward flank (8). The inward transition (19) from the recessed portion (17) to the core (2) of the panel (1) is square, or at a 90 degree angle, with the bottom of the core.

The upper side (20) of the upward tongue (7) is inclined, and runs downward from the side (21) of the upward tongue (7) facing toward the upward flank (8) towards the side (13) of the upward tongue (7) facing away from the upward flank (8).

A part of the side (21) of the upward tongue (7) is inclined towards the upward flank 8), wherein the angle ($\alpha$) enclosed between the plane (P) of the panel (1) and the inclined part of the side (21) of the upward tongue (7) facing the upward flank (8) lies between 90 and 45 degrees, and is about 87 to 88 degrees. The first coupling part (3) comprises an first bridge part (25), arranged between the core (2) and the upward tongue (7).

Figure 2:
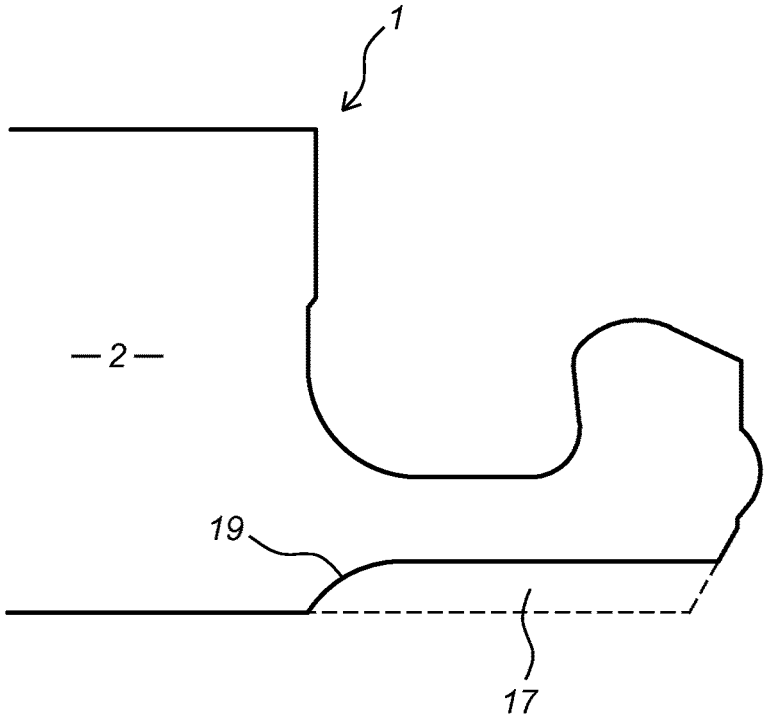
FIG. 2 schematically shows first coupling part according to the invention in a second embodiment.

FIG. 2 shows a variation on the embodiment shown in FIG. 1, with the difference that the inward transition (19) between the core (2) and the recessed portion (17) is curved.

Figure 3:
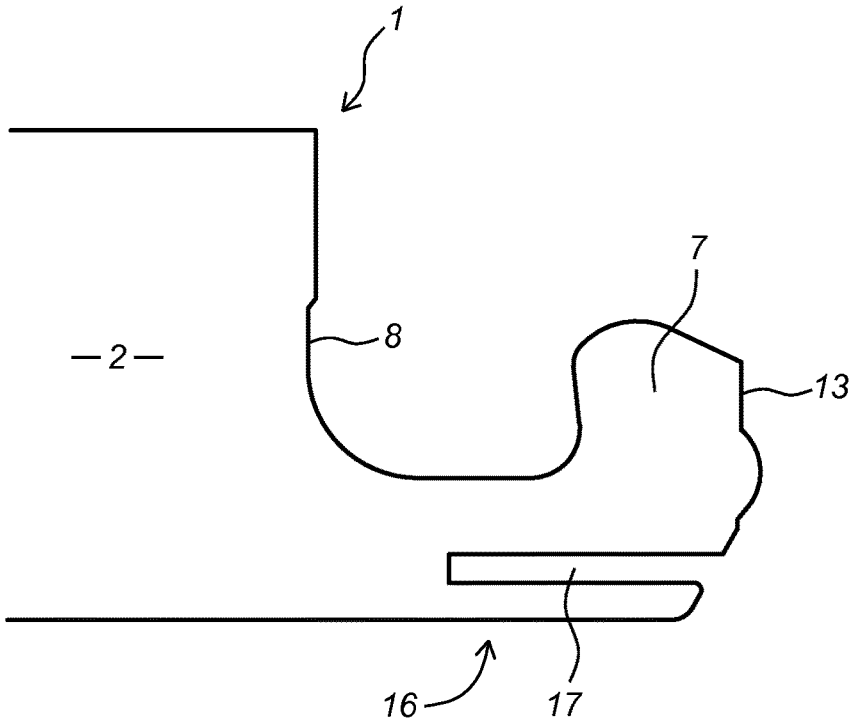
FIG. 3 schematically shows first coupling part according to the invention in a third embodiment.

FIG. 3 shows a variation on the FIGS. 1 and 2 embodiments in that the recessed portion (17) is not provided between a subfloor or supporting surface and the panel (1). Instead, the recessed portion (17) is provided in the bottom part (16) of the first coupling part (3), but is arranged as a sideward groove (17), from the side (13) of the upward tongue (7) facing away from the upward flank (8) inwards, in this case horizontally. Additionally, the depth of the groove (17), or the recessed portion (17) is not the complete distance (D), but a little over half the distance (D).

Figure 4:
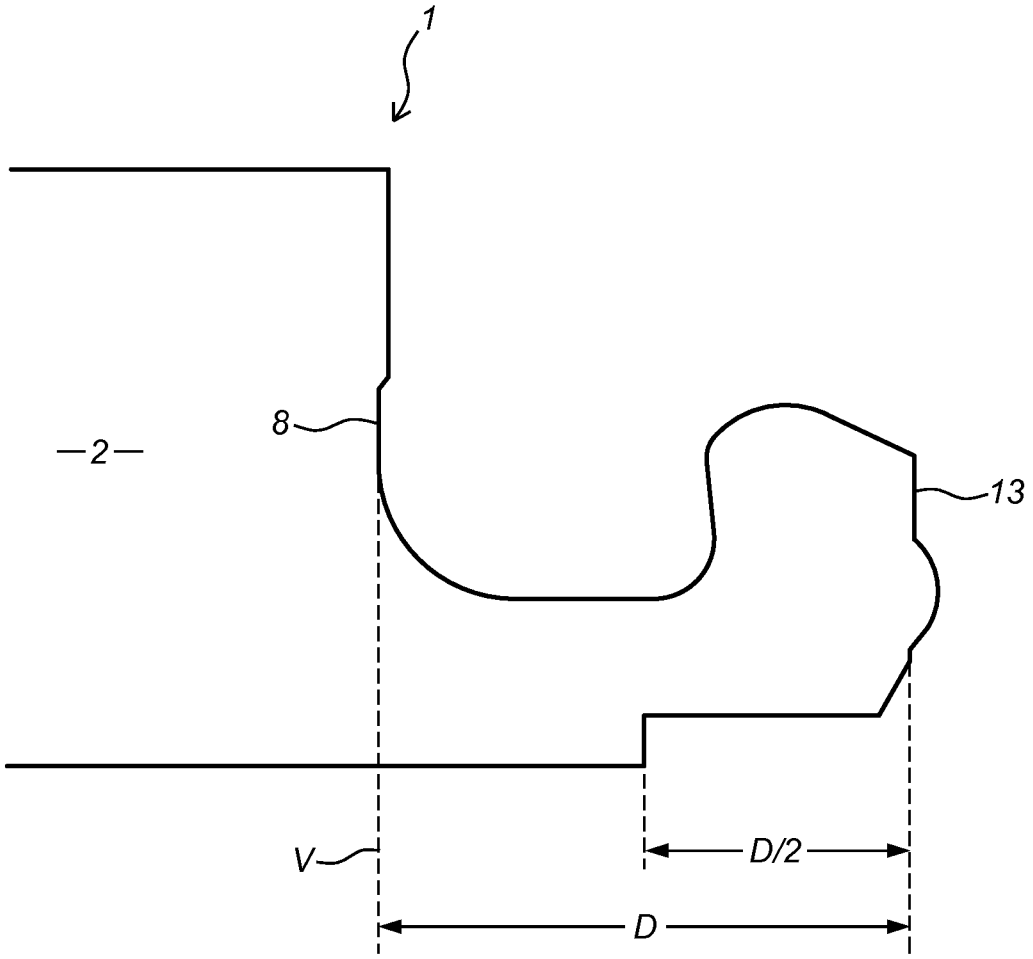
FIG. 4 schematically shows first coupling part according to the invention in a fourth embodiment.

FIG. 4 shows a variation on the FIG. 1 embodiment, in which the recessed portion (17) does not extend over the complete distance (D), but it does extend over half the distance (D/2).

Figure 5:
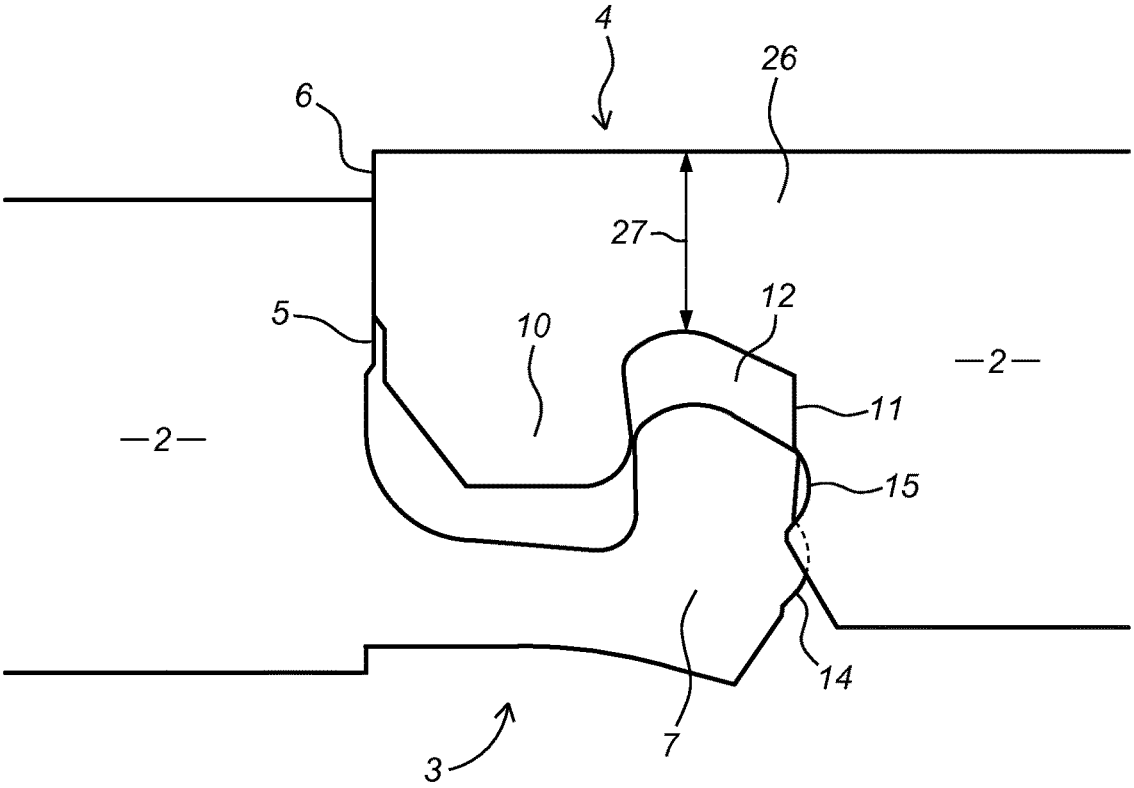
FIG. 5 schematically shows a first coupling part of a first panel and a second coupling part of a second panel, during coupling.

FIG. 5 schematically shows a first coupling part (3) of a first panel and a second coupling part (4) of a second panel, during coupling, in the final phases of coupling. The second coupling part (4) comprises a downward tongue (10), at least one downward flank (11) lying at a distance from the downward tongue (10), and a downward groove (12) formed in between the downward tongue (10) and the downward flank (11). This downward groove (12) is adapted to receive at least a part of an upward tongue (7) of a first coupling part (3) of the other panel (1); as shown in FIG. 5. A part of a side of the downward flank (11) is provided with a second locking element (15) in the form of a recess (15) for co-action with the first locking element (14) of the other panel (1).

FIG. 5 further shows that the recessed portion (17) is configured to allow downward movement of the upward tongue (7), into the recessed portion (17), during coupling of two adjacent panels (1), wherein the upward groove (9) is temporarily widened to facilitate coupling of two panels (1). During coupling the upward tongue (7) bends downward into the recessed portion (17), as indicated by the downward bended first coupling part (3). During this coupling motion, the first locking element (14) may need to be compressed or deformed slightly or partly, in order to allow for sufficient space for this bending motion.

The second coupling part (4) comprises a second bridge part (26), arranged between the core (2) and the downward tongue (10), wherein the second bridge part (26) comprises a weakened zone (27) of reduced thickness, to facilitate deformation of the second bridge part (26) during coupling.

Figure 6:
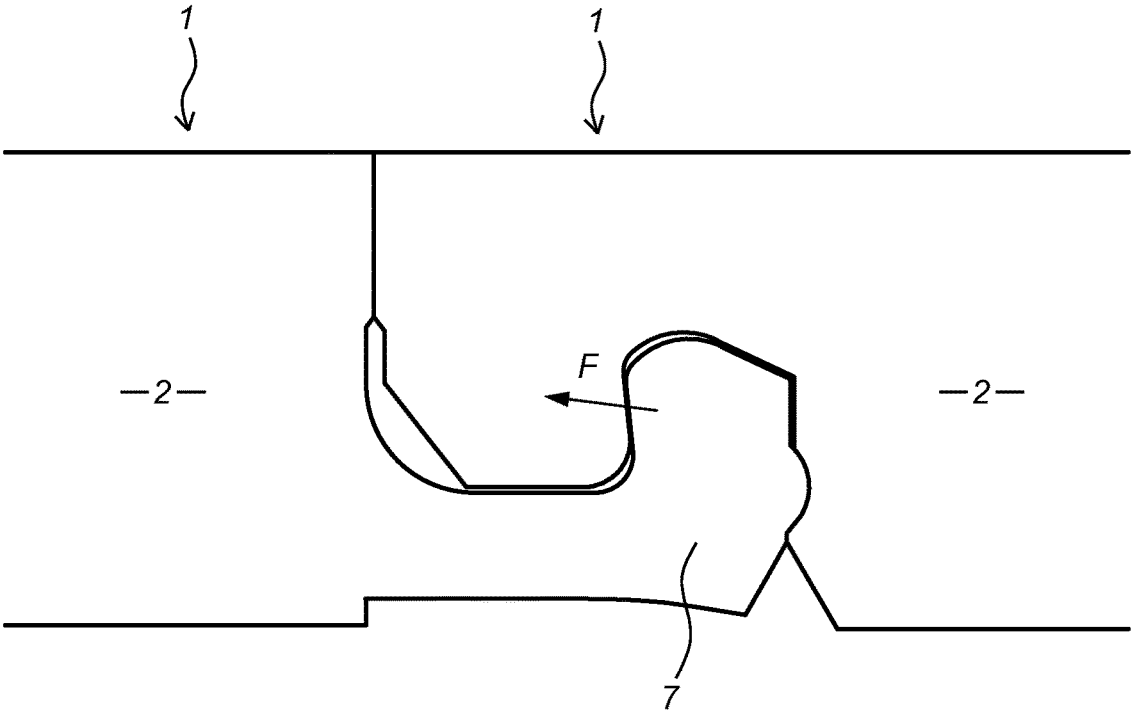
FIG. 6 schematically shows the first and second coupling part of FIG. 5 in coupled condition.

FIG. 6 shows the FIG. 5 embodiment shortly after coupling. In the FIG. 6 embodiment, the upward tongue (7) is slightly bend downward compared to for instance the FIG. 6 embodiment (which shown an uncoupled state). The upward tongue (7) does want to return to its initial position, and thus exerts a tension force (F), of coupling force, onto the panels. This force (F) in turn forces the panels (1) towards each other, and keeps the panels (1) together.

Figure 7:
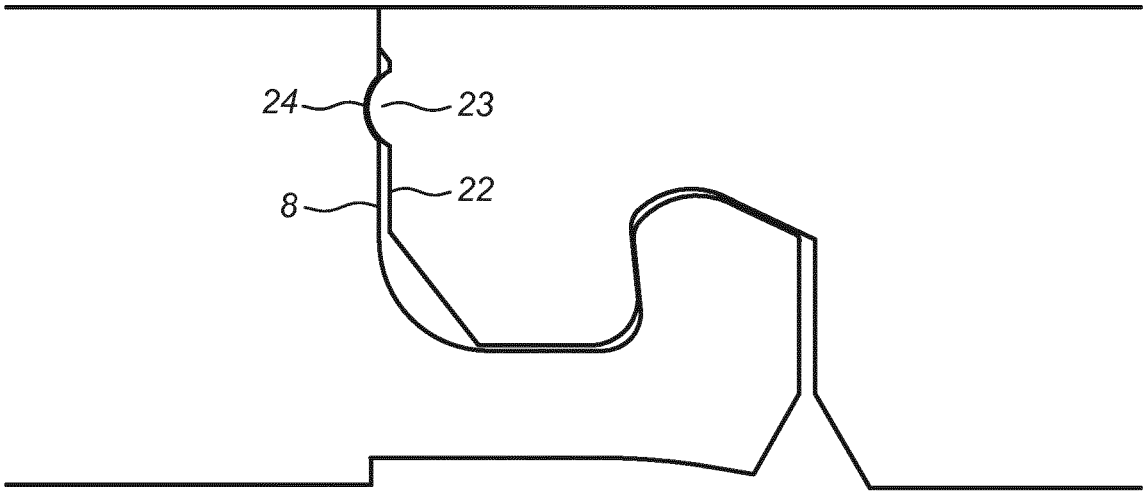
FIG. 7 schematically shows an embodiment of two coupled panels with a different location of locking elements.

FIG. 7 schematically shows an embodiment in which instead of the first (14) and second (15) locking elements, the panel comprises third (23) and fourth (24) locking elements. A part of a side (22) of the downward tongue (10) facing away from the downward flank (11) is provided with the third locking element (23), in the form of an outward bulge (23), adapted for co-action with a fourth locking element (24), in the form of a recess (24), of an adjacent panel (1). A part of the upward flank (8) is provided with a fourth locking element (24), in the form of a recess (24) for co-action with the third locking element (23) of the other panel (1).

Figure 8:
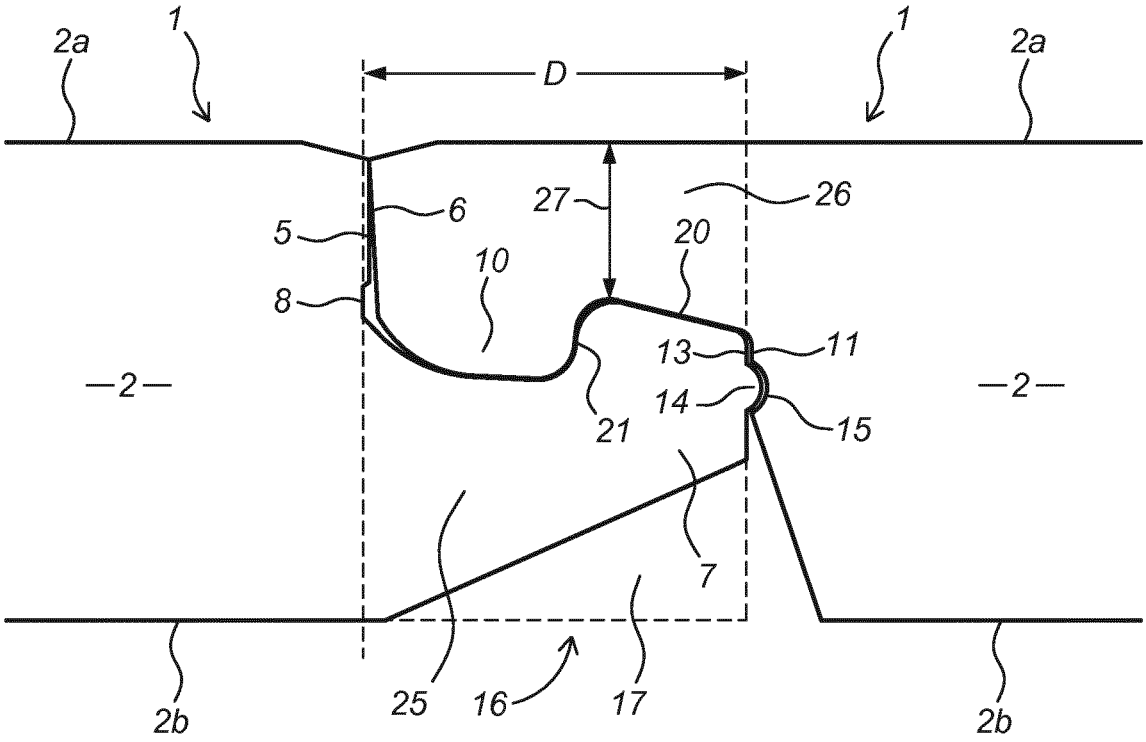
FIG. 8 schematically shows another embodiment according to the present invention, of two panels in coupled condition.

FIG. 8 schematically shows an embodiment according to the present invention, of two panels (1) in coupled condition. Features corresponding or fulfilling the same effect as features of the previous figures have been provided with the same reference numbers. Compared to earlier embodiments, the recessed portion (17) is shaped like a triangle, and the underside of the upward tongue (7) is at an angle. This triangular shape creates a space in the recessed portion (17) which increases towards the outside of the upward tongue (7).

It is at this side that the tongue (7) is most likely to bend downwardly the most. By increasing the space underneath the tongue (7) at the end, deformation at the end is facilitated most, and coupling of panels (1) is thus facilitated. The inclined recessed portion (17) extends over at least 90% of the thickness (D) between at least a part the side of the upward tongue (7) facing away from the upward flank (8), and the upward flank (8). The angle enclosed by the plane defined by the panel(s) 1 and the inclination of the recessed portion (17) is, in general, preferably situated between 15 and 35 degrees. In this example, the angle enclosed by the plane defined by the panel(s) 1 and the inclination of the recessed portion (17) is 25 degrees. It is advantageous in case the maximum height of the recessed portion (17) is preferably at least 30% of the panel thickness. In this case the maximum height of the recessed portion (17) is (about) ⅓ of the panel thickness. This embodiment is in particular advantageous in case the core is at least partially composed of a mineral material, like magnesium oxide and/or derivates therefrom. A common panel thickness, which is more or less equal to the core thickness, for these kinds of materials is 8 mm (or slightly larger like 10 mm or 12 mm).

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re) combined in order to arrive at a specific application.

It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof.

I claim:

1. A panel, comprising:

a centrally located core provided with an upper side and a lower side, which core defines a plane;

wherein the core has a thickness, which thickness is the distance between the upper side and the lower side of the core;

at least one first coupling part and at least one second coupling part connected respectively to opposite edges of the core, wherein the at least one first coupling part comprises an upward tongue, at least one upward flank lying at a distance from the upward tongue and an upward groove formed in between the upward tongue and the at least one upward flank, wherein the upward groove is adapted to receive at least a part of a downward tongue of a second coupling part of an adjacent panel;

wherein the at least one second coupling part comprises a downward tongue, at least one downward flank lying at a distance from the downward tongue, and a downward groove formed in between the downward tongue and the at least one downward flank, wherein the downward groove is adapted to receive at least a part of an upward tongue of a first coupling part of an adjacent panel;

wherein at least a part of a side of the upward tongue facing away from the at least one upward flank is provided with a first locking element, in the form of an outward bulge, adapted for co-action with a second locking element of an adjacent panel;

wherein at least a part of a side of the at least one downward flank is provided with a second locking element, in the form of a recess configured to receive at least a part of the outward bulge of an adjacent panel;

wherein the lower part of the first coupling part that is located between a side of the upward tongue facing away from the at least one upward flank and the at least one upward flank is the bottom part of the first coupling part;

wherein the bottom part of the first coupling part comprises a recessed portion extending between the at least one upward flank and the side of the upward tongue facing away from the at least one upward flank;

wherein the first coupling part and the second coupling part are configured such that, in a coupled condition, a pretension is existing, which forces the respective panels at the respective edges towards each other, wherein this is performed by applying overlapping contours of the first coupling part and the second coupling part, and wherein the first coupling part and the second coupling part are configured, such that the two of such panels can be coupled to each other by a fold-down movement and/or a vertical movement, wherein, in the coupled condition, at least a part of the downward tongue of the second coupling part is inserted in the upward groove of the first coupling part;

wherein the recessed portion is configured to allow downward movement of the upward tongue, into the recessed portion, during coupling of two adjacent panels, such that the upward groove is temporarily widened to facilitate coupling of the two adjacent panels;

wherein the recessed portion is an inclined recessed portion;

wherein at least a part of the side of the upward tongue facing the upward flank is inclined away from said upward flank;

wherein a part of a side of the downward tongue facing away from the at least one downward flank is provided with a third locking element, adapted for co-action with a fourth locking element of an adjacent panel, and wherein at least a part of the at least one upward flank is provided with the fourth locking element adapted for co-action with the third locking element of the adjacent panel;

wherein at least a part of the side of the upward tongue facing away from the at least one upward flank is located at a distance from at least a part of the at least one downward flank; and wherein the recessed portion extends at least halfway said distance.

2. The panel according to claim 1, wherein the recessed portion defines an area between the panel and a surface on which the panel is arranged.

3. The panel according to claim 1, wherein the recessed portion extends from the part of the side of the upward tongue facing away from the at least one upward flank inwards, such that at the bottom of the side of the upward tongue facing away from the at least one upward flank at least a part of the recessed portion is located.

4. The panel according to claim 1, wherein the entire side of the upward tongue facing the upward flank is inclined away from said upward flank.

5. The panel according to claim 1, wherein the upward tongue is oversized compared to the downward groove.

6. The panel according to claim 1, wherein the upper side of the upward tongue is inclined, and runs downward from the side of the upward tongue facing toward the at least one upward flank towards the side of the upward tongue facing away from the at least one upward flank.

7. The panel according to claim 1, wherein said distance between at least a part the side of the upward tongue facing away from the at least one upward flank and at least a part of the at least one upward flank is less than the thickness of the core.

8. The panel according to claim 1, wherein the first coupling part comprises a first bridge part, arranged between the core and the upward tongue, and wherein the second coupling part comprises a second bridge part, arranged between the core and the downward tongue, wherein the first bridge part comprises a weakened zone of reduced thickness, to facilitate deformation of the first bridge part during coupling and/or wherein the second bridge part comprises a weakened zone of reduced thickness, to facilitate deformation of the second bridge part during coupling.

9. The panel according to claim 1, wherein, during coupling, the upward tongue bends downward into the recessed portion and then returns at least partially towards its initial position.

10. The panel according to claim 1, wherein, in a coupled position, the upward tongue remains bent downwards at least partially compared to its initial position, and wherein, in the coupled position, the coupling parts exert a locking force onto the panels, forcing the panels towards each other under a tension force exerted by at least one of the coupling parts.

11. The panel according to claim 1, wherein the first coupling part and the second coupling part are configured such that, in a coupled condition, a pretension is existing, which forces the respective panels at the respective edges towards each other, wherein this is performed by applying overlapping contours of the first coupling part and the second coupling part.

12. The panel according to claim 1, wherein the recessed portion extends over at least 75% of the greatest distance definable between the at least one upward flank and the side of the upward tongue facing away from the at least one upward flank.

13. The panel according to claim 1, wherein the recessed portion extends over at least 80% of the distance.

* * * * *